US012310469B1

(12) United States Patent
Liu

(10) Patent No.: US 12,310,469 B1
(45) Date of Patent: May 27, 2025

(54) CARD HOLDER

(71) Applicant: Zhouwen Liu, Shenzhen (CN)

(72) Inventor: Zhouwen Liu, Shenzhen (CN)

( * ) Notice: Subject to any disclaimer, the term of this patent is extended or adjusted under 35 U.S.C. 154(b) by 0 days.

(21) Appl. No.: 18/772,344

(22) Filed: Jul. 15, 2024

(30) Foreign Application Priority Data

Jun. 27, 2024 (CN) ..... 202421501530.X

(51) Int. Cl.
*A45C 13/18* (2006.01)
*A45C 1/06* (2006.01)

(52) U.S. Cl.
CPC ..... *A45C 1/06* (2013.01); *A45C 13/185* (2013.01); *A45C 2001/065* (2013.01); *A45C 2001/067* (2013.01)

(58) Field of Classification Search
CPC ..... A45C 13/185; A45C 2013/1061; A45C 2001/067; A45C 11/182
USPC ..... 150/147
See application file for complete search history.

(56) References Cited

U.S. PATENT DOCUMENTS

| | | | | |
|---|---|---|---|---|
| 11,793,283 | B1 * | 10/2023 | Zhang | A45C 13/007 |
| 2013/0276943 | A1 * | 10/2013 | Minn | A45C 1/06 150/137 |
| 2015/0083289 | A1 * | 3/2015 | Johnson | A45C 1/06 150/144 |
| 2017/0112248 | A1 * | 4/2017 | Haarburger | A45C 13/001 |
| 2023/0136219 | A1 * | 5/2023 | Zhang | A45C 13/185 150/131 |
| 2023/0232947 | A1 * | 7/2023 | Kane | A45C 1/08 150/147 |
| 2023/0284758 | A1 * | 9/2023 | Espartero | A45C 11/321 |
| 2023/0413962 | A1 * | 12/2023 | Kane | A45C 1/08 |
| 2024/0260728 | A1 * | 8/2024 | Shan | A45C 11/182 |

* cited by examiner

*Primary Examiner* — Sue A Weaver

(57) ABSTRACT

A card holder includes at least one first elastic band and at least two clamping plates. The at least one the clamping plates includes a containing groove and a first convex block arranged in the containing groove; the first elastic band includes at least a first hanging hole, and the first convex block is fixed in the first hanging hole. The at least one first elastic band extends from a position adjacent to one end on one surface of the clamping plate to a position adjacent to one end on one surface of the other clamping plate; the at least one first elastic band also extends from a position adjacent to the other end on one surface of the clamping plate to a position adjacent to the other end on one surface of the other clamping plate, such that a first storage space for adapting to different thicknesses cards.

20 Claims, 13 Drawing Sheets

CARD HOLDER

CROSS-REFERENCE TO RELATED APPLICATIONS

The application claims priority of Chinese patent application CN202421501530X, filed on Jun. 27, 2024, which is incorporated herein by reference in its entirety.

TECHNICAL FIELD

The present disclosure relates to the technical field of daily necessities, in particular to a card holder.

BACKGROUND

Modern life involves dealing with cards more or less, such as a variety of IC cards, bank cards, supermarket cards, shopping cards, membership cards and so on. Such a large number of cards are difficult to store, prone to disorder and often cause many unnecessary troubles. For this reason, card holders have emerged in the market, which are used to store and organize cards, solving the problems of card disorder and difficulty in finding them. Currently, in the existing card holder, the internal space is fixed. A number of cards placed can only increase with the increase in the volume of the card holder. In the case of a large number of cards, it is not easy to store all of the cards, affecting user experience. Furthermore, even if there are few cards, the remaining space is wasted and the volume of the card holder doesn't decrease, resulting in it taking up a lot of space. This affects the user's travel and portability, causing inconvenience to the user.

SUMMARY

The main purpose of the present disclosure is to provide a card holder to solve the problem that the existing card holder has the fixed internal space.

A card holder includes at least one first elastic band and at least two clamping plates, wherein at least one the clamping plates includes a containing groove and a first convex block arranged in the containing groove; the first elastic band includes at least a first hanging hole, and the first convex block is fixed in the first hanging hole;

- the at least one first elastic band extends from a position adjacent to one end on one surface of the clamping plate to a position adjacent to one end on one surface of the other clamping plate;
- the at least one first elastic band also extends from a position adjacent to the other end on one surface of the clamping plate to a position adjacent to the other end on one surface of the other clamping plate, such that a first storage space for adapting to different thicknesses cards is formed by a cooperation between the at least one first elastic band and at least the two clamping plates.

In one embodiment, the first elastic band is provided with a first reinforcing sheet adjacent to each of the first hanging holes, and the first reinforcing sheet is configured for reinforcing a strength between the first elastic band position and a peripheral side of the first hanging hole.

In one embodiment, the first reinforcing sheet is sewn onto the first elastic band by sewing threads.

In one embodiment, the first reinforcing sheet is attached on the first elastic band by glue or a double-sided adhesive tape.

In one embodiment, the first reinforcing sheet is sewn onto the first elastic band by sewing threads and forms sewn marks, the sewn marks are two and located at two different sides of the first hanging hole.

In one embodiment, the first reinforcing sheet is a plastic sheet in a ring shape and surrounds the periphery of the first hanging hole.

In one embodiment, one side of at least one clamping plate is provided with a notch for pushing a card.

In one embodiment, the number of the clamping plates is two, the clamping plates includes a first clamping plate and a second clamping plate respectively; the number of the containing grooves is four, the containing grooves include a first groove, a second groove, a third groove and a fourth groove respectively; the first groove and the second groove are arranged at two opposite ends of the first clamping plate, and the third groove and the fourth groove are arranged at two opposite ends of the second clamping plate; the at least one first elastic band includes a first band body and a second band body, the number of the first hanging holes is four, wherein two of the first hanging holes are arranged on the first band body, the other two of the first hanging holes are arranged on the second band body; two ends of the first band body are respectively arranged into the first groove and the third groove, the two first hanging holes on the first band body are respectively sleeved on the first convex block of the first groove and the third groove, a part of the first band body is arranged on one side of the first clamping plate; two ends of the second band body are respectively arranged into the second groove and the fourth groove, the two first hanging holes on the second band body are respectively sleeved on the first convex block of the second groove and the fourth groove, a part of the second band body is arranged on the other side of the first clamping plate.

In one embodiment, the card holder further includes a second elastic band, the first clamping plate is provided a fifth groove, the fifth groove is arranged between the first groove and the third groove; the second clamping plate is provided a sixth groove, the sixth groove is arranged between the second groove and the fourth groove; second convex blocks are respectively arranged into the fifth groove and the sixth groove, the second elastic band is provided with two second hanging holes; both ends of the second elastic band are respectively arranged into the fifth groove and the sixth groove, the two second hanging holes on the second elastic band are respectively sleeved on the second convex block of the fifth groove and the second convex block of the sixth groove, a part of the second elastic band is arranged at the bottom of the first clamping plate and the second clamping plate.

In one embodiment, the first clamping plate includes a first base plate and a first decorative plate, the first groove, the second groove and the fifth groove are formed by connecting the first base plate and the first decorative plate, the first convex blocks in the first groove, the second groove and the fifth groove are arranged on the first base plate; the second clamping plate includes a second base plate and a second decorative plate, the third groove, the fourth groove and the sixth groove are formed by connecting the second base plate and the second decorative plate, the first convex blocks on the third groove, the fourth groove and the sixth groove are arranged on the second base plate.

In one embodiment, the first decorative plate is able to be detached and arranged on the first base plate, the second decorative plate is able to be detached and arranged on the second base plate, the first decorative plate and the second decorative plate are provided with a first text and image for decoration.

In one embodiment, the first decorative plate is fixed on the first base plate by screws, and the second decorative plate is fixed on the second base plate by screws.

In one embodiment, the card holder further includes a first clasp for fixing the card holder to a waist, and the first clasp is arranged on the first clamping plate or the second clamping plate.

In one embodiment, the first clasp includes a hanging part, a butting part and a fixing part, the hanging part and the fixing part are oppositely arranged, two ends of the butting part are respectively connected with the hanging part and the fixing part, an end of the fixing part is bent towards the direction adjacent to the hanging part to form a hook part, the other end of the fixing part is bent towards the direction adjacent to the hanging part to form a hook part, the second decorative plate is provided with a seventh groove on a side adjacent to the second base plate; a width of the fixing part is less than a width of the third groove, the fixing part is arranged in the third groove and the hook part is arranged in the seventh groove.

In one embodiment, the first clasp is fixed on the second decorative plate by a fastening screw, and the fastening screw passes through the second decorative plate from the third groove and locks on the first clasp.

In one embodiment, the first clamping plate and the second clamping plate are provided with a guide opening on a side surface far away from the second elastic band, and the guide opening is an opening of a first storage space.

In one embodiment, the number of the clamping plates is two, the clamping plates are a first plate and a second plate respectively; the number of the containing grooves is two and includes a first embedding groove and a second embedding groove; the first embedding groove and the second embedding groove are arranged on the first plate, the number of the first hanging holes is two, the two first hanging holes are arranged at two ends of the first elastic band, a first through hole and a second through hole are arranged at two ends of the second plate, the first plate is provided with a first avoidance opening connected with the first embedding groove and a second avoidance opening connected with the second embedding groove; two ends of the first elastic band are respectively arranged into the first embedding groove and the second embedding groove, the two first hanging holes are respectively sleeved on the first convex blocks of the first embedding groove and the second embedding groove; one end of the first elastic band extends out of the first embedding groove and then passes through the first avoidance opening and the first through hole in sequence, and extends along a surface of the second plate away from the first plate, and then passes through the second through hole and the second avoidance opening in sequence and is arranged into the second embedding groove, and a second storage space is formed between the first elastic band and the second plate.

In one embodiment, the first plate includes a third base plate and a third decorative plate, and the first embedding groove and the second embedding groove are formed by connecting the third base plate and the third decorative plate.

In one embodiment, the third decorative plate is able to be detached and arranged on the third base plate, the third decorative plate is provided with second images and texts for decoration on the surface far away from the third decorative plate; the second plate is provided with a fourth decorative plate on one of the surfaces far away from the first plate, the fourth decorative plate is provided with third images and texts for decoration, and at least part of the fourth decorative plate is arranged between the first elastic band and the second plate.

In one embodiment, wherein the card holder further includes a second clasp, the second clasp is arranged on the second plate or the first elastic band; the second clasp is provided with pass-through holes at positions adjacent to both ends, both ends of the second clasp is provided with entrances connected with the pass-through holes, and the first elastic band passes through the two pass-through holes.

The present disclosure has the beneficial effects:

two clamping plates and the first elastic band are configured. The first elastic band cooperates with the two clamping plates to form the first storage space. When the first storage space is not filled with items such as cards or change, the two clamping plates are adhered under the pull of the first elastic band. At this point, the first storage space is minimized, and the size of the card holder is also able to be minimized. When an item such as cards or change is placed in the card holder, the first elastic band gets stretched to generate a contracting force, which pulls the two clamping plates to clamp the item such as cards or change. Therefore, the function of holding items such as cards or change is accomplished. The volume of the card holder grows along with the increase in the quantity of placed items, facilitating users' carrying and utilization without taking up additional space. It addresses the issue that the leftover space of the first storage space of the existing card holder occupies the volume of the card holder, as well as the problem that the fixed first storage space impacts the users' sense of experience. In addition, the first elastic band is accommodated by the storage groove arranged on the clamping plate, and by the cooperation of the first convex block with the first hanging hole on the first elastic band, the first elastic band is fixed on the clamping plate.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

DETAILED DESCRIPTION OF THE EMBODIMENTS

Figure 1:
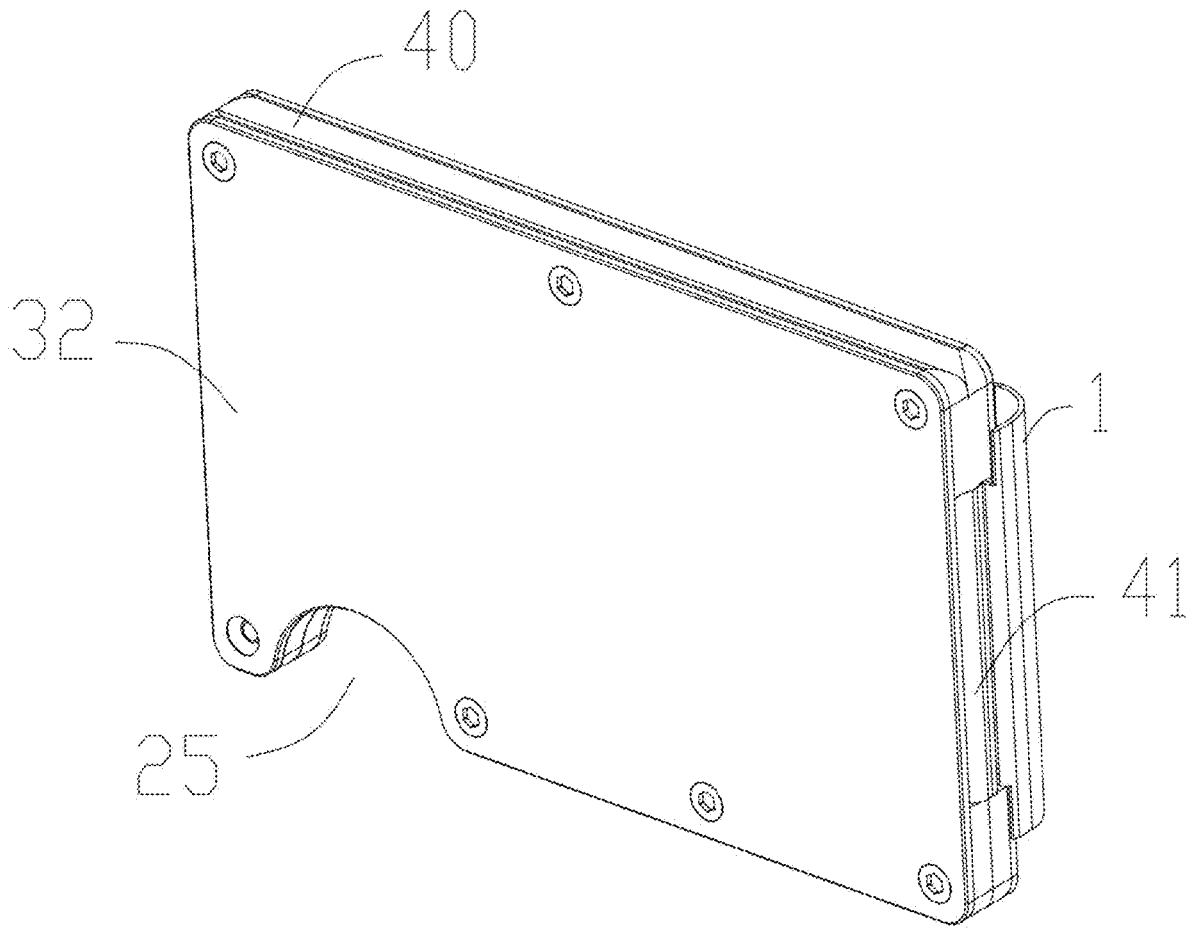
FIG. 1 is a schematic diagram of an overall structure of an embodiment of the present disclosure.
Figure 2:
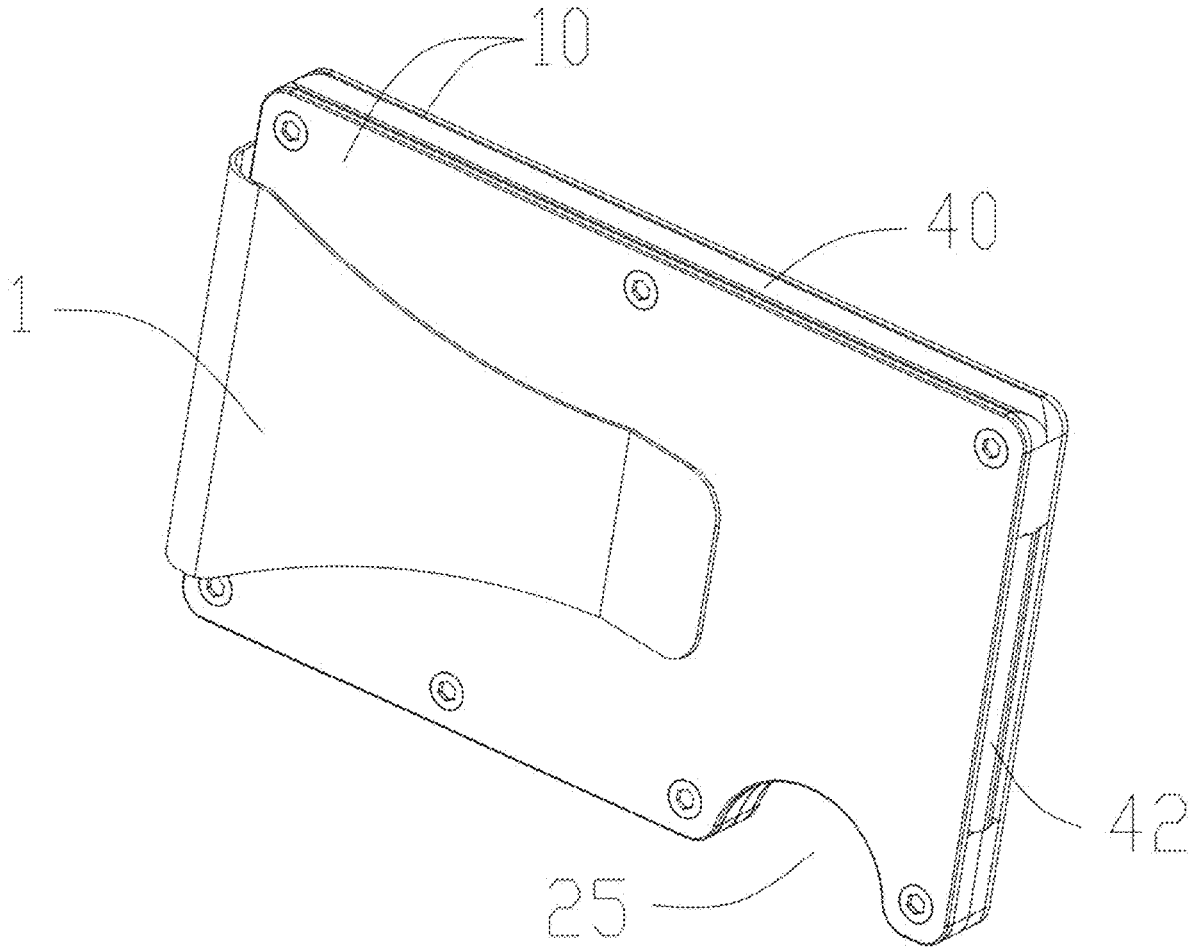
FIG. 2 is a schematic diagram from another view of the embodiment of the present disclosure.
Figure 3:
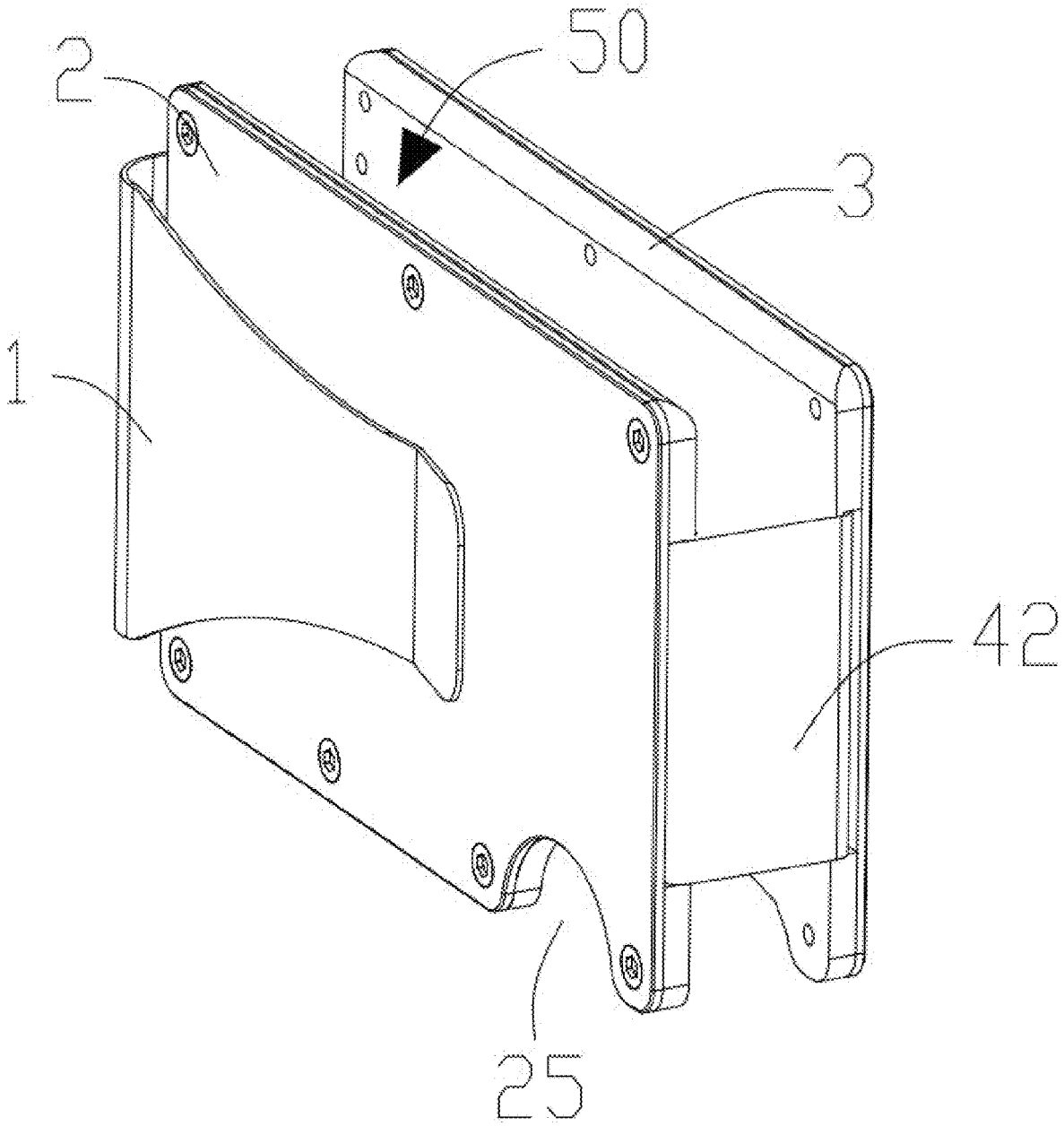
FIG. 3 is a schematic diagram of the card holder in a using state of the embodiment of the present disclosure.
Figure 4:
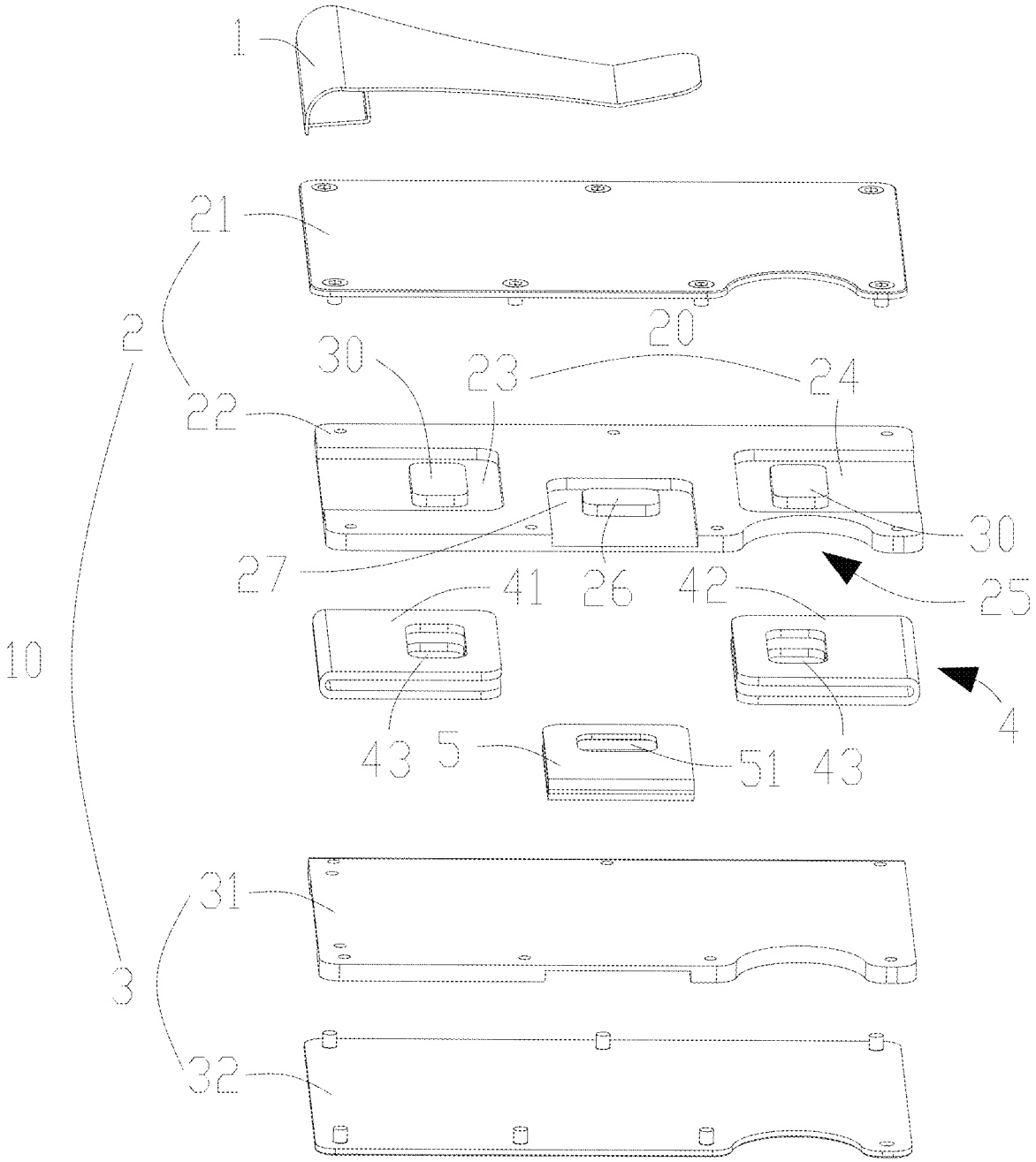
FIG. 4 is an exploded diagram of the card holder of the embodiment of the present disclosure.
Figure 5:
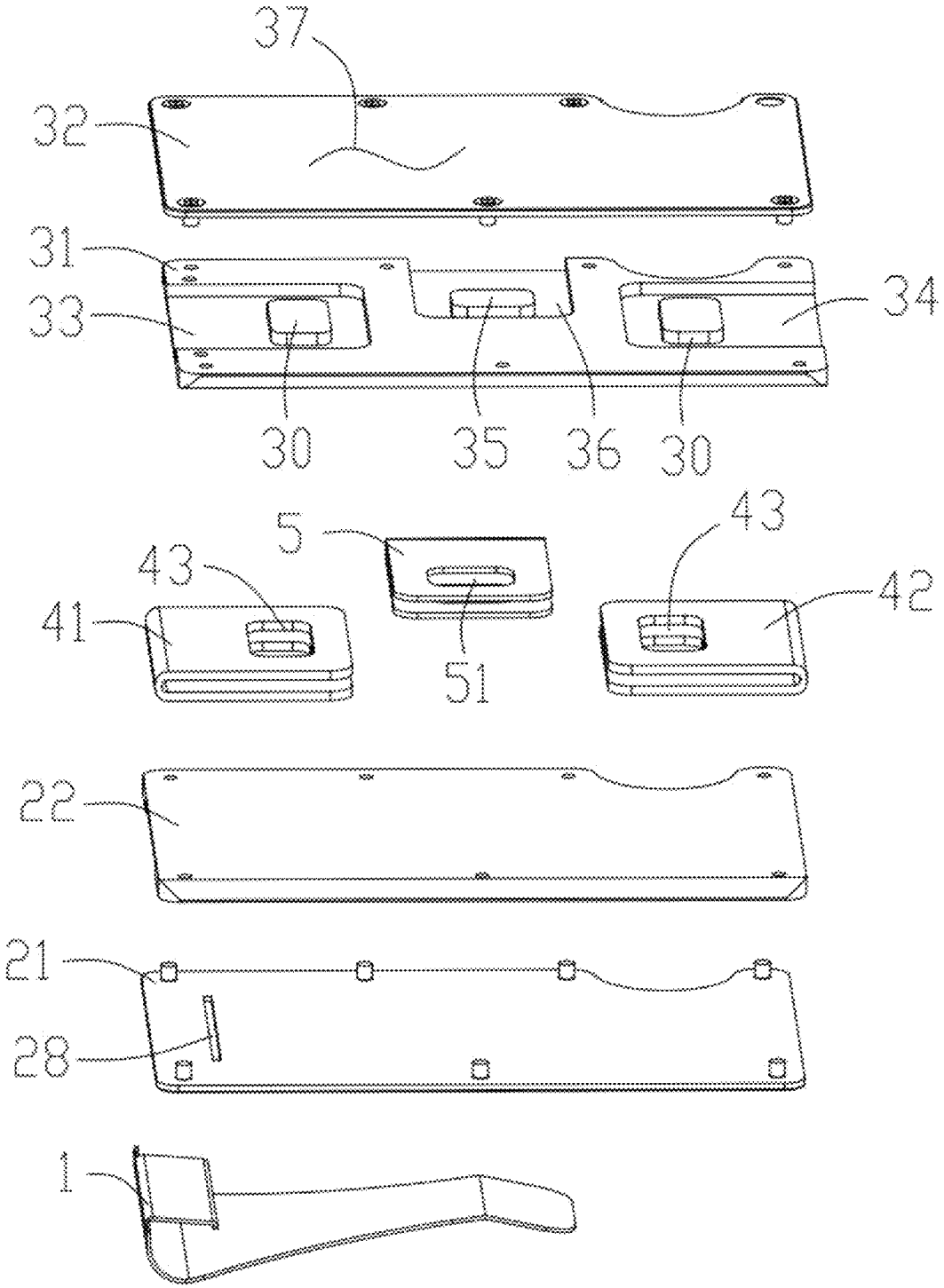
FIG. 5 is an exploded diagram of the card holder from another view of the embodiment of the present disclosure.
Figure 6:
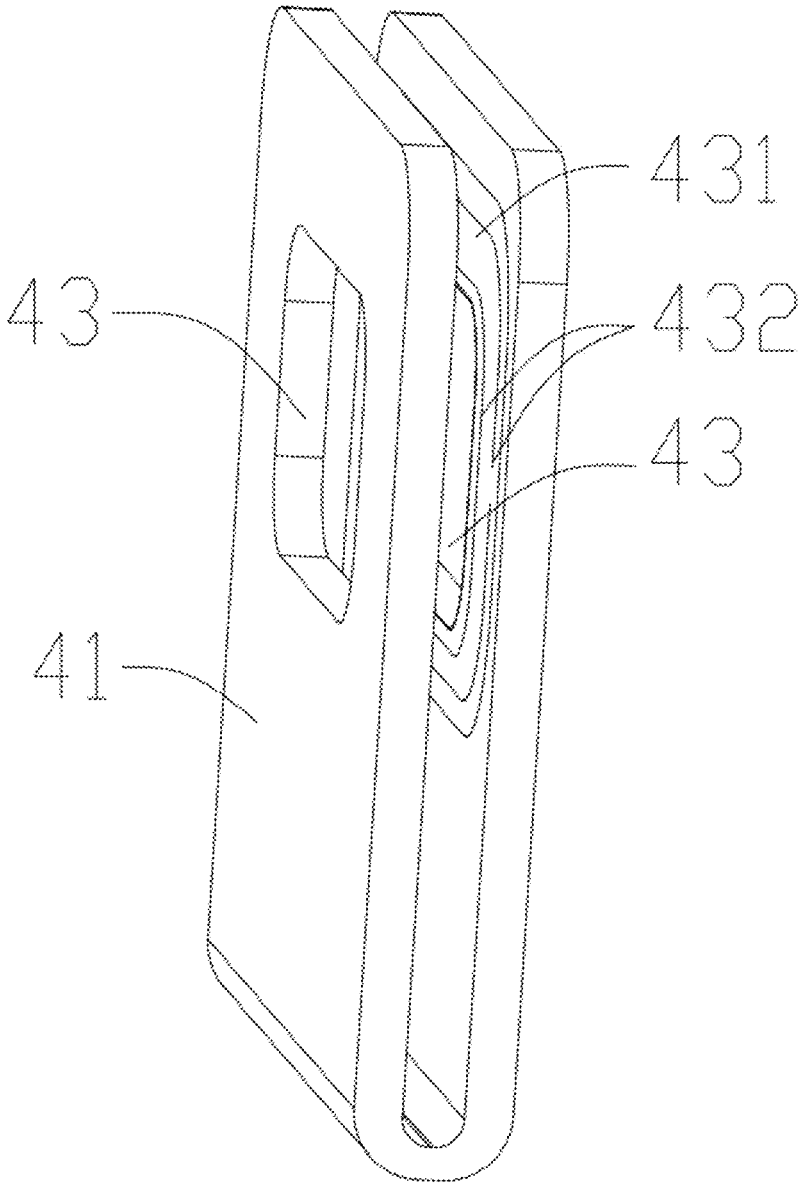
FIG. 6 is a structural diagram of an assembly of a first strap body and a first reinforcing sheet of the card holder of the embodiment of the present disclosure.
Figure 7:
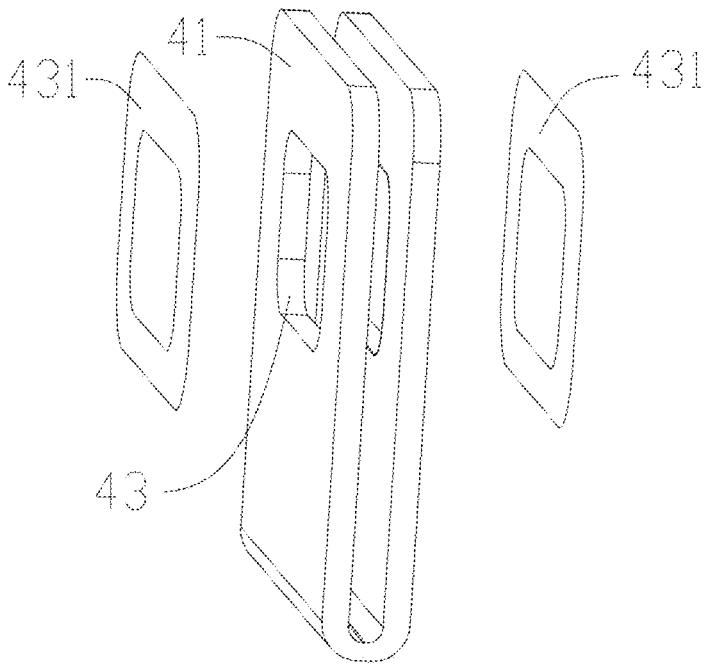
FIG. 7 is a decomposition diagram of the first strap body and the first reinforcing sheet of the embodiment of the present disclosure.
Figure 8:
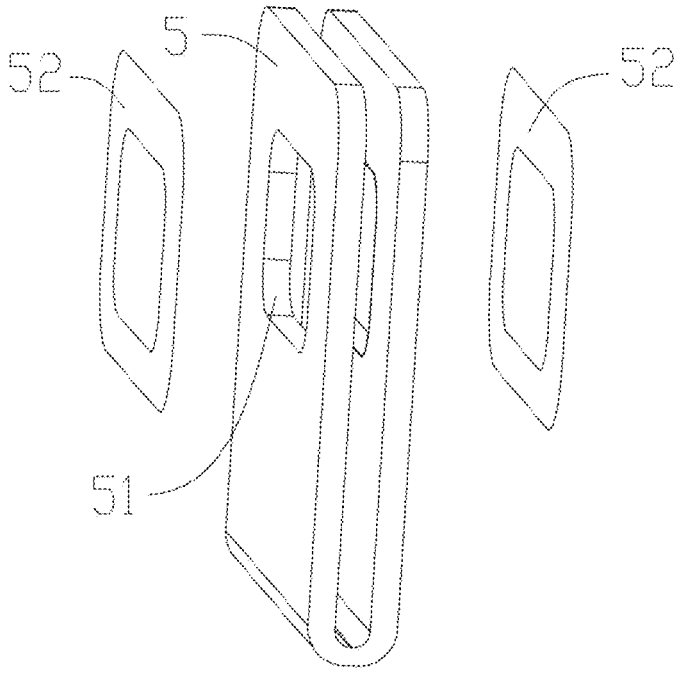
FIG. 8 is a decomposition diagram of a second elastic band and a second reinforcing sheet of the card holder of the embodiment of the present disclosure.
Figure 9:
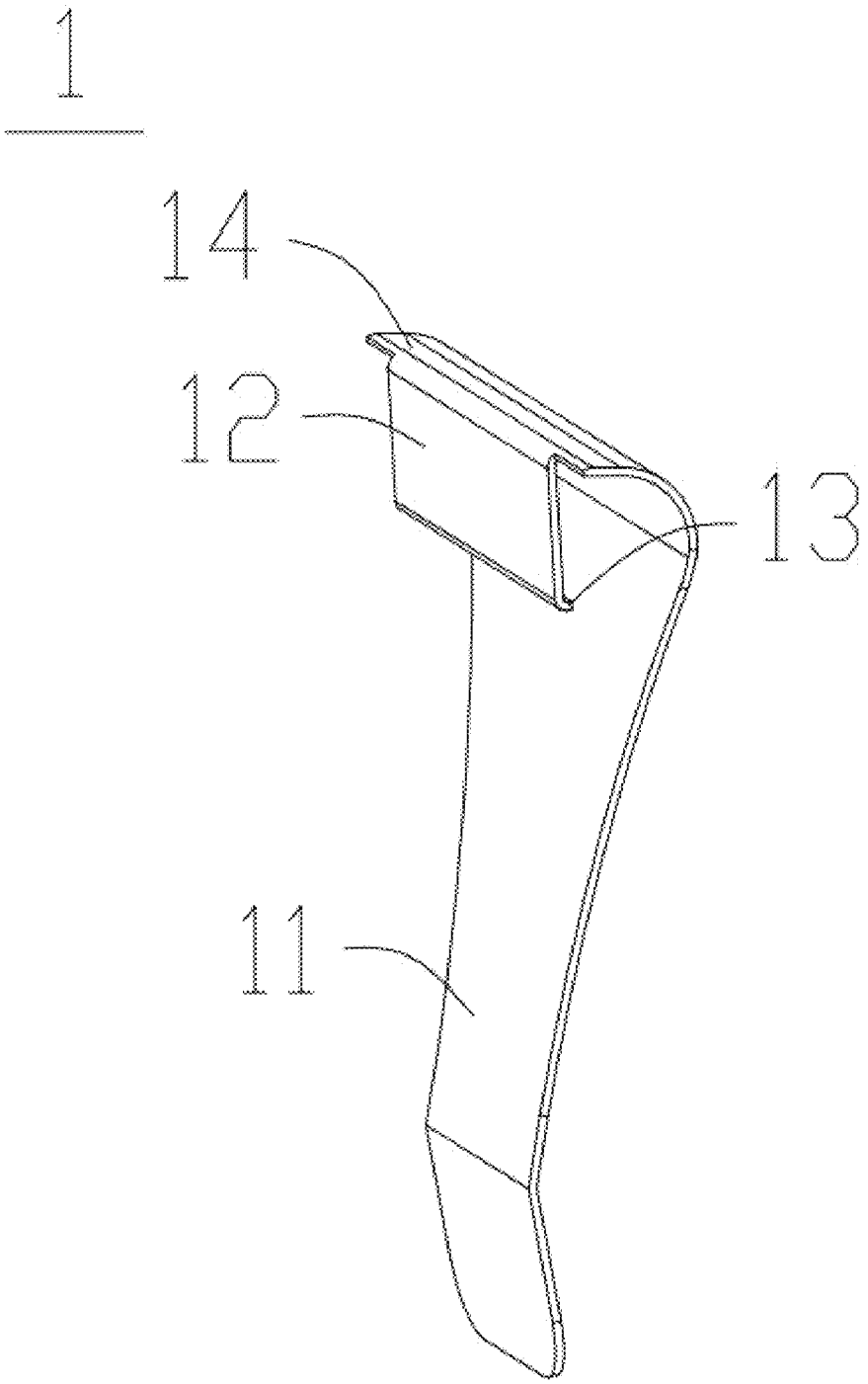
FIG. 9 is a structural diagram of a clasp of the embodiment of the present disclosure.

The technical solutions in the embodiments of the present disclosure will be clearly and completely described below in conjunction with the accompanying drawings in the embodiments of the present disclosure. Apparently, the described embodiments are only a part of the embodiments of the present disclosure, rather than all the embodiments. Based on the embodiments in the present disclosure, all other embodiments obtained by those ordinarily skilled in the art without doing creative work shall fall within the protection scope of the present disclosure.

Referring to FIG. 1 to FIG. 14, a card holder of the embodiment of the present disclosure is provided. The card holder includes a first elastic band 4 and at least two clamping plates 10. At least one of the clamping plates 10 includes a containing groove 20 and a first convex block 30 arranged in the containing groove 20. The first elastic band 4 includes at least a first hanging hole 43, and the first convex block 30 is fixed in the first hanging hole 43. The at least one first elastic band 4 extends from a position adjacent to one end on one surface of the clamping plate 10 to a position adjacent to one end on one surface of the other clamping plate 10. The at least one first elastic band 4 also extends from a position adjacent to the other end on one surface of the clamping plate 10 to a position adjacent to the other end on one surface of the other clamping plate 10. Such that a first storage space 50 for adapting to different thicknesses cards is formed by a cooperation between the at least one first elastic band 4 and at least the two clamping plates 10.

In this embodiment, two clamping plates 10 and the first elastic band 4 are configured. The first elastic band 4 cooperates with the two clamping plates 10 to form the first storage space 50. When the first storage space 50 is not filled with items such as cards or change, the two clamping plates 10 are adhered under the pull of the first elastic band 4. At this point, the first storage space 50 is minimized, and the size of the card holder is also able to be minimized. When an item such as cards or change is placed in the card holder, the first elastic band 4 gets stretched to generate a contracting force, which pulls the two clamping plates 10 to clamp the item such as cards or change. Therefore, the function of holding items such as cards or change is accomplished. The volume of the card holder grows along with the increase in the quantity of placed items, facilitating users' carrying and utilization without taking up additional space. It addresses the issue that the leftover space of the first storage space 50 of the existing card holder occupies the volume of the card holder, as well as the problem that the fixed first storage space 50 impacts the users' sense of experience. In addition, the first elastic band 4 is accommodated by the storage groove 20 arranged on the clamping plate 10, and by the cooperation of the first convex block 30 with the first hanging hole 43 on the first elastic band 4, the first elastic band 4 is fixed on the clamping plate 10.

In this implementation, the first elastic band 4 is in a flat shape, the first elastic band 4 is provided with a first reinforcing sheet 431 adjacent to each of the first hanging holes 43, and the first reinforcing sheet 431 is configured for reinforcing a strength between the first elastic band 4 position and a peripheral side of the first hanging hole 43, in order to fix the shape of the first hanging holes 43 and when the first hanging holes 43 are sleeved on the first convex block 30. By utilizing the first reinforcing sheet 431, the first hanging hole 43 is able to more firmly be sleeved on the first convex block 30, enhancing the force by which the first elastic band 4 is fixed on the clamping elastic sheet. Specifically, the first reinforcing sheet 431 is able to be sewn onto the first elastic band 4 by sewing threads so as to fix the first reinforcing sheet 431 on the first elastic band 4. In another implementation, the first reinforcing sheet 431 is also able to be attached on the first elastic band 4 by glue or a double-sided adhesive tape. In order to fix the first reinforcing sheet 431 on the first elastic band 4 more firmly, the first reinforcing sheet 431 is first attached on the first elastic band 4 by glue or a double-sided adhesive tape, and then sewed by sewing threads. Of which, the shape of the first hanging hole 43 is able to be further limited and the hardness of the first elastic band 4 around the first hanging hole 43 is able to be improved by glue or a double-sided adhesive tape. In order to further improve the stability of the connection between the first reinforcing sheet 431 and the first elastic band 4, the first reinforcing sheet 431 is sewn onto the first elastic band 4 by sewing threads and forms sewn marks 432, the sewn marks 432 are two and located at two different sides of the first hanging hole 43.

In the above-mentioned implementations, the first reinforcing sheet 431 is able to be a plastic sheet, and the first reinforcing sheet 431 is in a ring shape and surrounds the periphery of the first hanging hole 43.

In this implementation, one side of at least one clamping plate 10 is provided with a notch 25 for pushing a card. That is, after the card is placed in the first storage space 50, a part of the card will be exposed through the notch 25. Thus, when the user takes the card, the card is able to be pushed out from the first storage space 50 by the notch 25 to facilitate the user to take the card.

In the practical application of the card holder, the number of the first hanging holes 43 is able to be two, and the two first hanging holes 43 are arranged at the positions of the first elastic band 4 adjacent to two ends. The number of the first convex block 30 is able to be one, both of the two first hanging holes 43 on the two ends of the first elastic band 4 are sleeved onto the first convex block 30. This makes the first elastic band 4 become a ring-shaped, which also makes the first elastic band 4 to be secured without shifting its position.

In the practical application of the card holder, the number of the first hanging holes 43 and the first convex blocks 30 is able to be one, the first elastic band 4 is a ring-shaped. In this way, the first elastic band 4 is able to be prevented from moving by placing the first convex block 30 in the first hanging hole 43, and the connecting part of the two ends of the first elastic band 4 is able to be prevented from moving to the outside of the containing groove 20.

Referring to FIG. 1 to FIG. 9, in the practical application of the card holder, the number of the clamping plates is able to be two, a first clamping plate 3 and a second clamping plate 2 respectively. The number of the containing grooves is four and they are a first groove 33, a second groove 34, a third groove 23 and a fourth groove 24 respectively. The first groove 33 and the second groove 34 are arranged at two opposite ends of the first clamping plate 3, and the third groove 23 and the fourth groove 24 are arranged at two opposite ends of the second clamping plate 2. The first elastic band 4 includes a first band body 41 and a second band body 42. The number of the first hanging holes is four, wherein two of the first hanging holes 43 are arranged on the first band body 41, the other two of the first hanging holes 43 are arranged on the second band body 42. Two ends of the first band body 41 are respectively arranged into the first groove 33 and the third groove 23, the two first hanging holes 43 on the first band body 41 are respectively sleeved on the first convex block 30 of the first groove 33 and the third groove 23. In this way, the first band body 41 is able to be fixed. Two ends of the second band body 42 are respectively arranged into the second groove 34 and the fourth groove 24, the two first hanging holes 43 on the second band body 42 are respectively sleeved on the first convex block 30 of the second groove 34 and the fourth groove 24. In this way, the second band body 42 is able to be fixed. A part of the first band body 41 is arranged on one side of the first clamping plate 3, and a part of the second band body 42 is arranged on the other side of the first clamping plate 3. Therefore, the first band body 41 and the second band body 42 are used for limiting the width of the first storage space 50, and the first band body 41, the second band body 42, the first clamping plate 3, and the second clamping plate 2 cooperate to store articles of different thicknesses, so that the articles are clamped and fixed by the first clamping plate 3 and the second clamping plate 2.

In the above-mentioned implementations, the card holder further includes a second elastic band 5, the first clamping plate 3 is provided a fifth groove 36, and the fifth groove 36 is arranged between the first groove 33 and the third groove 23. The second clamping plate 2 is provided a sixth groove 27, and the sixth groove 27 is arranged between the second groove 34 and the fourth groove 24. The fifth groove 36 and the sixth groove 27 are each provided with a second convex block 26, and the second elastic band 5 is provided with two second hanging holes 51. Both ends of the second elastic band 5 are respectively arranged into the fifth groove 36 and the sixth groove 27, the two second hanging holes 51 on the second elastic band 5 are respectively sleeved on the second convex block 26 of the fifth groove 36 and the second convex block 26 of the sixth groove 27, a part of the second elastic band 5 is arranged at the bottom of the first clamping plate 3 and the second clamping plate 2. The second elastic band 5 is configured to limit the bottom of the first storage space 50, that is, the second elastic band 5 is used to support the bottom of the card or change and other items, so as to prevent the card from leaking out of the bottom of the card holder, which affects the user's experience.

In the above-mentioned implementations, both the first band body 41 and the second band body 42 are provided with the first reinforcing sheet 431 at the circumferential side of each first hanging hole 43. The second elastic band 5 is provided with a second reinforcing sheet 52 at the circumferential side of each second hanging hole 51. Wherein, the material and structure of the first reinforcing sheet 431 and the second reinforcing sheet 52 are the same.

In the above-mentioned implementations, for the convenience of the production and manufacture of the card holder in this implementation, the first clamping plate 3 includes a first base plate 31 and a first decorative plate 32, the first groove 33, the second groove 34 and the fifth groove 36 are formed by connecting the first base plate 31 and the first decorative plate 32, the first convex blocks 30 in the first groove 33, the second groove 34 and the fifth groove 36 are arranged on the first base plate 31. The second clamping plate 2 includes a second base plate 22 and a second decorative plate 21, the third groove 23, the fourth groove 24 and the sixth groove 27 are formed by connecting the second base plate 22 and the second decorative plate 21, the first convex blocks 30 in the third groove 23, the fourth groove 24 and the sixth groove 27 are arranged on the second base plate 22.

In this implementation, the first decorative plate 32 is able to be detached and arranged on the first base plate 31, the second decorative plate 21 is able to be detached and arranged on the second base plate 22, the first decorative plate 32 and the second decorative plate 21 are provided with a first text and image 37 for decoration, therefore, users are able to configure the first decorative plate 32 and the second decorative plate 21 with different first text and image 37 according to their preferences at different times to change the style of the card holder. This is able to reduce the number of times that users directly replace the card holders with different first texts and images 37, and lower the consumption. Specifically, the first decorative plate 32 is fixed on the first base plate 31 by screws, so that the first decorative plate 32 is able to be detached and arranged on the first base plate 31. The second decorative plate 21 is fixed on the second base plate 22 by screws, so that the second decorative plate 21 is able to be detached and arranged on the second base plate 22.

In another implementation, the first decorative plate 32 is also able to be detachably fixed to the first base plate 31 by means of a snap, a magnetic suction, or a Velcro and so on, so that the first decorative plate 32 is able to be detached and arranged on the first base plate 31. The second decorative plate 21 is also able to be detachably fixed to the second base plate 22 by means of a snap, a magnetic suction, or a Velcro and so on, so that the second decorative plate 21 is able to be detached and arranged on the second base plate 22.

In this implementation, the card holder further includes a first clasp 1 for fixing the card holder to a waist, and the first clasp 1 is arranged on the first clamping plate 3 or the second clamping plate 2. With the first hanging hole 43, it is convenient for users to hang the card holder on a trouser belt or leather belt and so on, for convenient carrying.

Specifically, in this implementation, the first clasp 1 includes a hanging part 11, a butting part 14 and a fixing part 12, the hanging part 11 and the fixing part 12 are oppositely arranged, two ends of the butting part 14 are respectively connected with the hanging part 11 and the fixing part 12, an end of the fixing part 12 is bent towards the direction adjacent to the hanging part 11 to form a hook part 13, the second decorative plate 21 is provided with a seventh groove 28 on a side adjacent to the second base plate 22. A width of the fixing part 12 is less than a width of the third groove 23, the fixing part 12 is arranged in the third groove 23 and the hook part 13 is arranged in the seventh groove 28, these arrangements cooperate with the second base plate 22 and the second decorative plate 21 to fix the first clasp 1 on the second clamping plate 2. Furthermore, the fixing part 12 is on a side of the first band body 41 that is far away from the second base band 22. Wherein the first band is an elastic band with cushioning property. Both sides of the fixing part 12 respectively abut against the first band body 41 and the second decorative plate 21, so that the first clasp 1 is able to be prevented from shaking, the fixing stability of the first hanging hole 43 is improved, and the structure is more compact.

Figure 13:
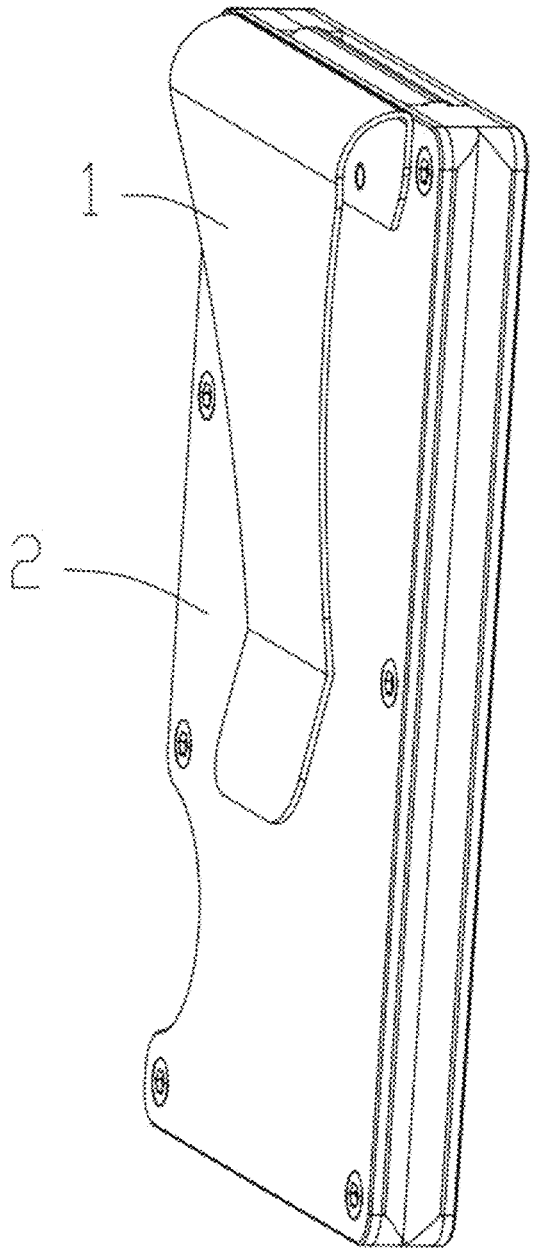
FIG. 13 is a schematic diagram of the card holder of an overall structure of another embodiment of the present disclosure.
Figure 14:
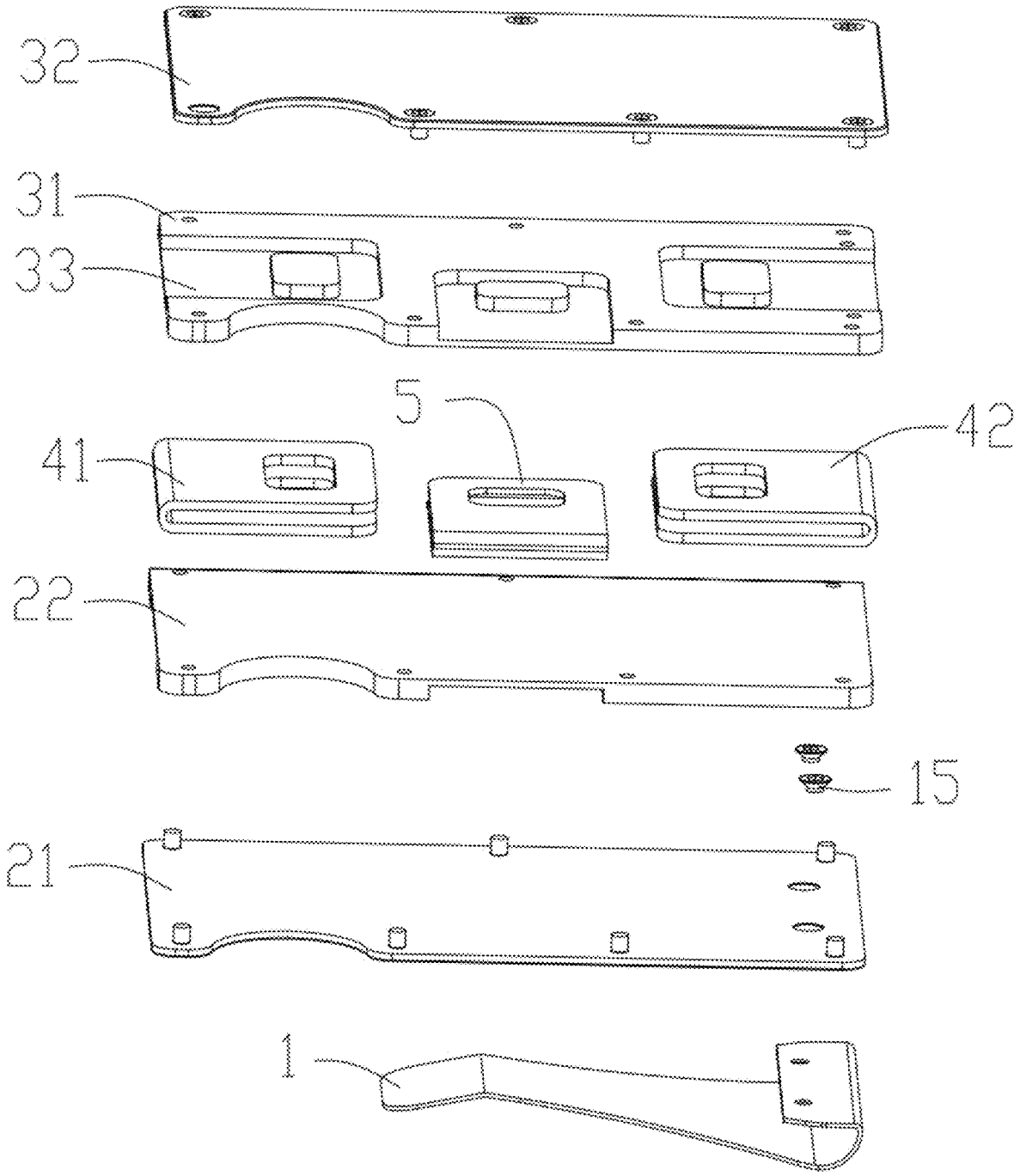
FIG. 14 is an exploded diagram of the card holder of another embodiment of the present disclosure.

In another implementation, referring to FIG. 13 and FIG. 14, the first clasp 1 is also able to fix on the second decorative plate 21 by a fastening screw 15. Specifically, in order to facilitate fixing of the first clasp 1, one end of the fastening screw 15 passes through the second decorative plate from the third groove and locks on the first clasp 1.

In this implementation, the first clamping plate 3 and the second clamping plate 2 are provided with a guide opening 40 on a side surface far away from the second elastic band 5, and the guide opening 40 is an opening of the first storage space 50, specifically, the side wall of the guiding opening 40 is an inclined surface or a cambered surface. The guide opening 40 is used for guiding, so that items such as cards or change are able to be conveniently placed into the first storage space 50.

Figure 10:
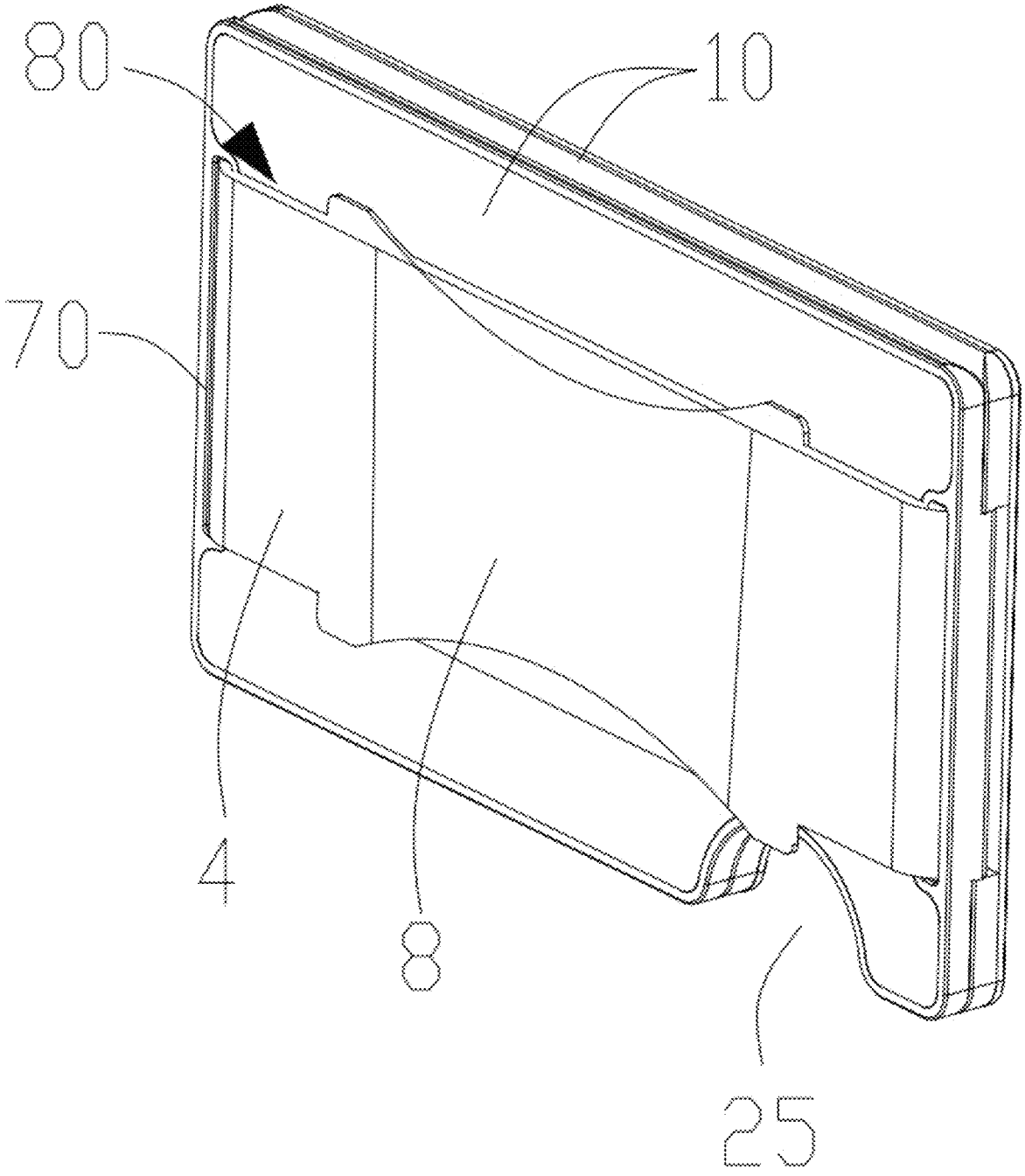
FIG. 10 is a schematic diagram of an overall structure of a card holder of another embodiment of the present disclosure.
Figure 11:
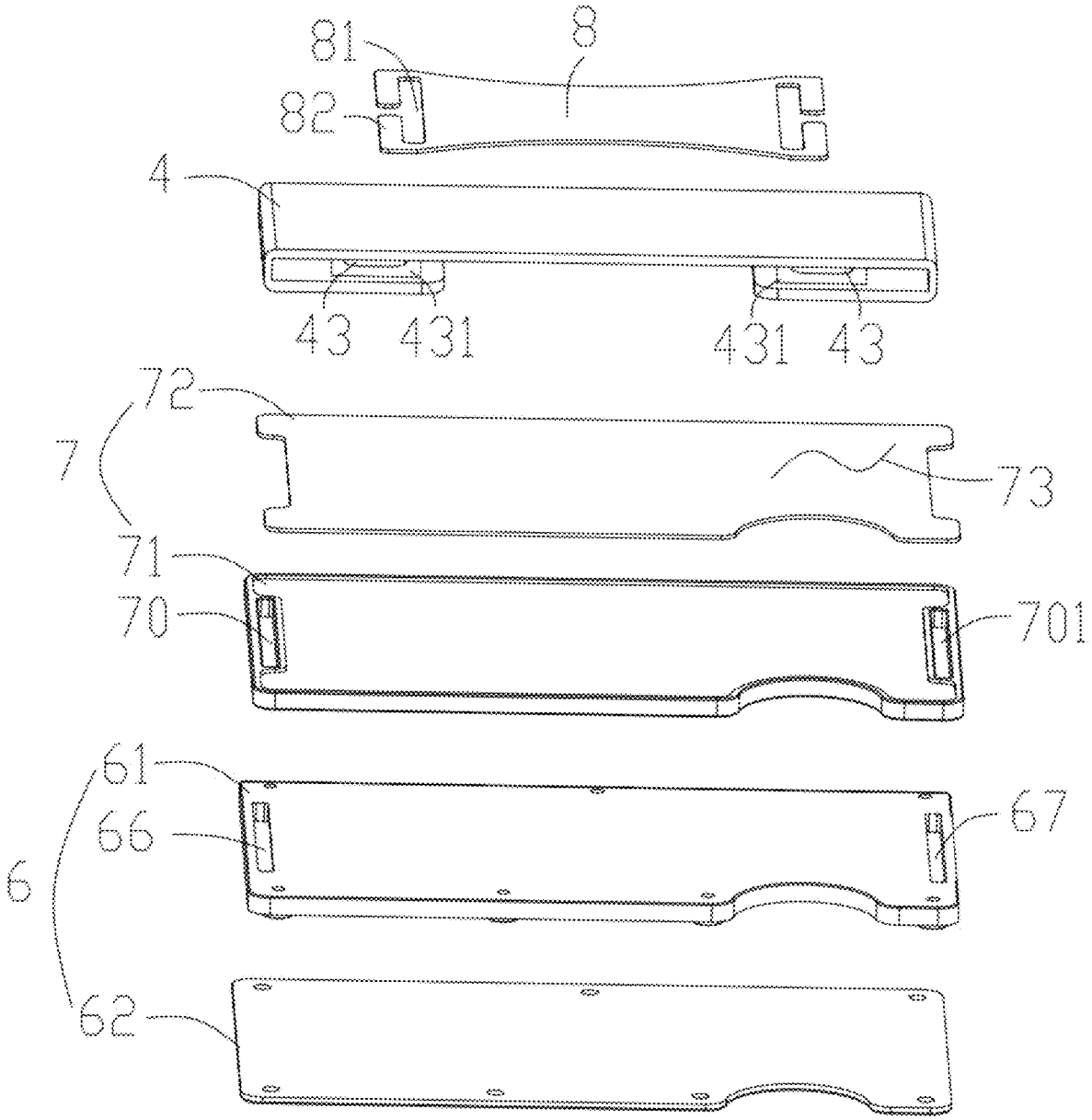
FIG. 11 is an exploded diagram of the card holder of another embodiment of the present disclosure.
Figure 12:
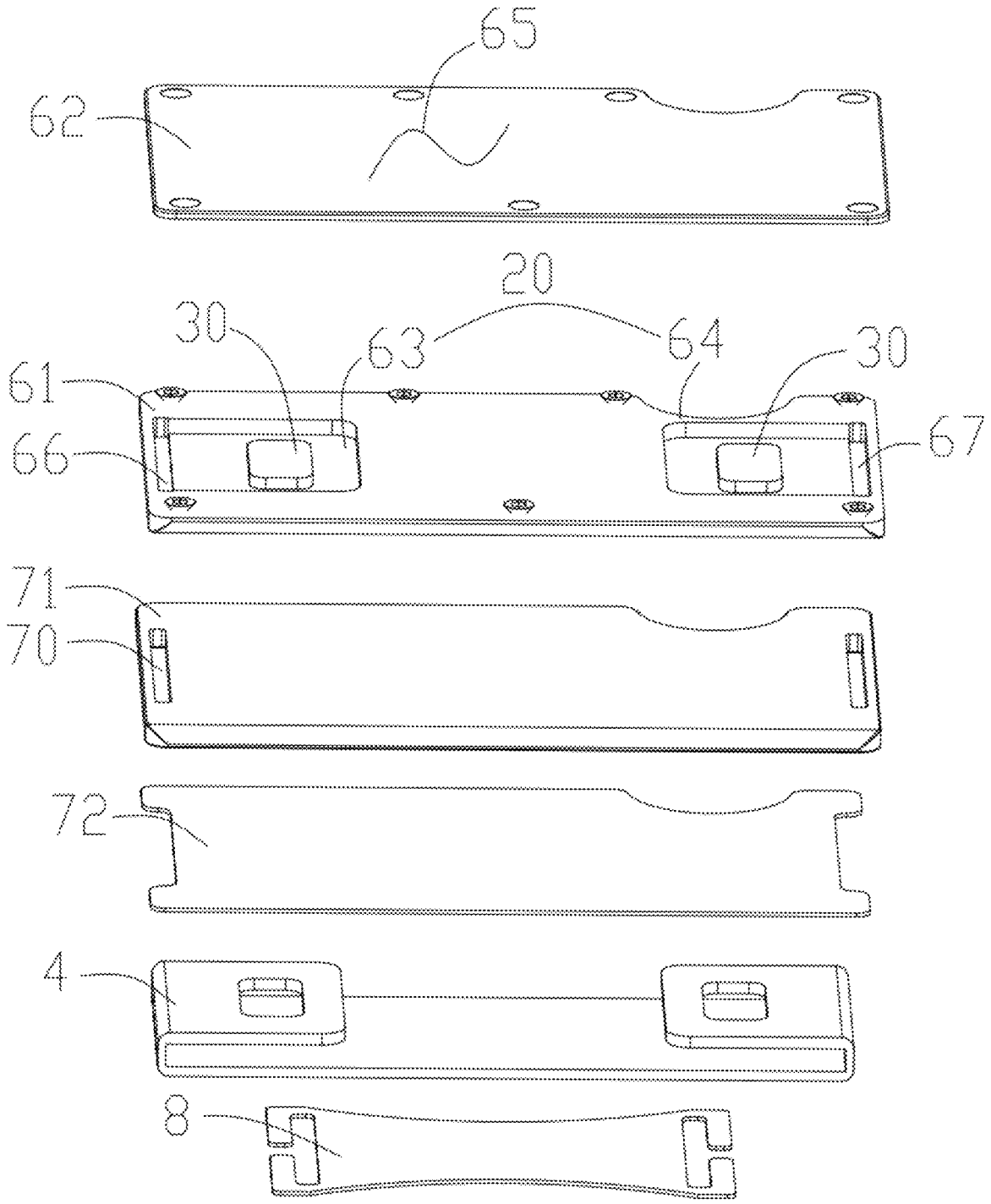
FIG. 12 is an exploded diagram of the card holder from another view of another embodiment of the present disclosure.

Referring to FIG. 10 to FIG. 12, in practical application, another implementation of the card holder, the number of the clamping plates 10 is two, the clamping plates 10 are a first plate 6 and a second plate 7 respectively. The number of the containing grooves 20 is two and include a first embedding groove 63 and a second embedding groove 64. The number of the first hanging holes 43 is two, the two first hanging holes 43 are arranged at the positions of the first elastic band 4 adjacent to two ends, a first through hole 70 and a second through hole 701 are arranged at the positions of the second plate 7 adjacent to two ends. The first plate 6 is provided with a first avoidance opening 66 connected with the first embedding groove 63 and a second avoidance opening 67 connected with the second embedding groove 64. Both ends of the first elastic band 4 are respectively arranged into the first embedding groove 63 and the second embedding groove 64, the two first hanging holes 43 are respectively sleeved on the first convex blocks 30 of the first embedding groove 63 and the second embedding groove 64. One end of the first elastic band 4 extends out of the first embedding groove 63 and then passes through the first avoidance opening 66 and the first through hole 70 in sequence, and extends along a surface of the second plate 7 away from the first plate 6, and then passes through the second through hole 701 and the second avoidance opening 67 in sequence and is arranged into the second embedding groove 64. In this way, by using two clamping panels 10 and one first elastic band 4, the first storage space 50 suitable for different numbers of cards is able to be formed. And the volume of the card holder is able to be increased along with the increase of the stored items without taking up more space. Furthermore A second storage space 80 is able to be formed between the first elastic band 4 and the second plate 7 for users to place cards, paper money, and so on, and conveniently take them. With the first avoidance opening 66 and the second avoidance opening 67, the two side walls of the first plate 6 and the second plate are able to align.

In the above-mentioned implementations, in order to facilitate the production and manufacture of the card holder of the embodiment, the first plate 6 includes a third base plate 61 and a third decorative plate 62, and the first embedding groove groove 63 and the second embedding groove 64 are formed by connecting the third base plate 61 and the third decorative plate 62.

In this embodiment, the third decorative plate 62 is able to be detached and arranged on the third base plate 61, the third decorative plate 62 is provided with second images and texts 65 for decoration on the surface far away from the third decorative plate 62. Therefore, users are able to configure the third decorative plate 62 with different second texts and images 65 according to their preferences at different times to change the style of the card holder. The second plate 7 is provided with a fourth decorative plate 72 on one of the surfaces far away from the first plate 6, the fourth decorative plate 72 is provided with third images and texts 73 for decoration, and at least part of the fourth decorative plate 72 is arranged between the first elastic band 4 and the second plate 7 to prevent the use of the second storage space 80 from being influenced. Furthermore, the fourth decorative plate 72 is able to be detached and arranged on the first plate 6 for the users to replace the fourth decorative plate 72. Specifically, by means of a screw, a snap, a magnetic suction, or a Velcro and so on, the third decorative plate 62 is able to be fixed on the third base plate 61 and the fourth decorative plate 72 is able to be fixed on the second plate 7.

In the above-mentioned implementations, wherein the card holder further includes a second clasp 8, the second clasp 8 is arranged on the second plate 7 or the first elastic band 4, it is convenient for users to hang the card holder on a trouser belt or leather belt and so on, for convenient carrying.

In this embodiment, the second clasp 8 is provided with pass-through holes 81 at positions adjacent to both ends. Both ends of the second clasp 8 are provided with entrances 82 connected with the pass-through holes 81, and the first elastic band 4 passes through the two pass-through holes 81. By hooks or similar items that are capable of being adapted to the second hanging hole 51, the card holder is able to be fixed at the desired position.

The above descriptions are only preferred embodiments of the present disclosure, and are not intended to limit the patent scope of the present disclosure. Any equivalent structural transformation made by using the content of the specification and the drawings of the present disclosure under the invention idea of the present disclosure, directly or indirectly applied to other related technical fields, shall all be included in the scope of patent protection of the present disclosure.

What is claimed is:

1. A card holder, comprising at least one first elastic band and at least two clamping plates, wherein at least one the clamping plates comprises a containing groove and a first convex block arranged in the containing groove; the first elastic band comprises at least a first hanging hole, and the first convex block is fixed in the first hanging hole;

the at least one first elastic band extends from a position adjacent to one end on one surface of the clamping plate to a position adjacent to one end on one surface of the other clamping plate; the at least one first elastic band also extends from a position adjacent to the other end on one surface of the clamping plate to a position adjacent to the other end on one surface of the other clamping plate, such that a first storage space for adapting to different thicknesses cards is formed by a cooperation between the at least one first elastic band and at least the two clamping plates.

2. The card holder according to claim 1, wherein the first elastic band is provided with a first reinforcing sheet adjacent to the first hanging hole, and the first reinforcing sheet is configured for reinforcing a strength between the first elastic band position and a peripheral side of the first hanging hole.

3. The card holder according to claim 2, wherein the first reinforcing sheet is sewn onto the first elastic band by sewing threads.

4. The card holder according to claim 3, wherein the first reinforcing sheet is attached on the first elastic band by glue or a double-sided adhesive tape.

5. The card holder according to claim 4, wherein the first reinforcing sheet is sewn onto the first elastic band by sewing threads and forms sewn marks, the sewn marks are two and located at two different sides of the first hanging hole.

6. The card holder according to claim 5, wherein the first reinforcing sheet is a plastic sheet in a ring shape and surrounds the periphery of the first hanging hole.

7. The card holder according to claim 6, wherein one side of at least one clamping plate is provided with a notch for pushing a card.

8. The card holder according to claim 6, wherein a number of the clamping plates is two, the clamping plates comprises a first clamping plate and a second clamping plate respectively; a number of the containing grooves is four, the containing grooves comprise a first groove, a second groove, a third groove and a fourth groove respectively; the first groove and the second groove are arranged at two opposite ends of the first clamping plate, and the third groove and the fourth groove are arranged at two opposite ends of the second clamping plate; the at least one first elastic band comprises a first band body and a second band body, a number of the at least a first hanging hole is four, wherein two of the first hanging holes are arranged on the first band body, the other two of the first hanging holes are arranged on the second band body; two ends of the first band body are respectively arranged into the first groove and the third groove, the two first hanging holes on the first band body are respectively sleeved on the first convex block of the first groove and the third groove, a part of the first band body is arranged on one side of the first clamping plate; two ends of the second band body are respectively arranged into the second groove and the fourth groove, the two first hanging holes on the second band body are respectively sleeved on the first convex block of the second groove and the fourth groove, a part of the second band body is arranged on the other side of the first clamping plate.

9. The card holder according to claim 8, wherein the card holder further comprises a second elastic band, the first clamping plate is provided a fifth groove, the fifth groove is arranged between the first groove and the third groove; the second clamping plate is provided a sixth groove, the sixth groove is arranged between the second groove and the fourth groove; second convex blocks are respectively arranged into the fifth groove and the sixth groove, the second elastic band is provided with two second hanging holes; both ends of the second elastic band are respectively arranged into the fifth groove and the sixth groove, the two second hanging holes on the second elastic band are respectively sleeved on the second convex block of the fifth groove and the second convex block of the sixth groove, a part of the second elastic band is arranged at the bottom of the first clamping plate and the second clamping plate.

10. The card holder according to claim 9, wherein the first clamping plate comprises a first base plate and a first decorative plate, the first groove, the second groove and the fifth groove are formed by connecting the first base plate and the first decorative plate, the first convex blocks in the first groove, the second groove and the fifth groove are arranged on the first base plate; the second clamping plate comprises a second base plate and a second decorative plate, the third groove, the fourth groove and the sixth groove are formed by connecting the second base plate and the second decorative plate, the first convex blocks on the third groove, the fourth groove and the sixth groove are arranged on the second base plate.

11. The card holder according to claim 10, wherein the first decorative plate is able to be detached and arranged on the first base plate, the second decorative plate is able to be detached and arranged on the second base plate, the first decorative plate and the second decorative plate are provided with a first text and image for decoration.

12. The card holder according to claim 11, wherein the first decorative plate is fixed on the first base plate by screws, and the second decorative plate is fixed on the second base plate by screws.

13. The card holder according to claim 12, wherein the card holder further comprises a first clasp for fixing the card holder to a waist, and the first clasp is arranged on the first clamping plate or the second clamping plate.

14. The card holder according to claim 13, wherein the first clasp comprises a hanging part, a butting part and a fixing part, the hanging part and the fixing part are oppositely arranged, two ends of the butting part are respectively connected with the hanging part and the fixing part, an end of the fixing part is bent towards the direction adjacent to the hanging part to form a hook part, the other end of the fixing part is bent towards the direction adjacent to the hanging part to form a hook part, the second decorative plate is provided with a seventh groove on a side adjacent to the second base plate; a width of the fixing part is less than a width of the third groove, the fixing part is arranged in the third groove and the hook part is arranged in the seventh groove.

15. The card holder according to claim 14, wherein the first clasp is fixed on the second decorative plate by a fastening screw, and the fastening screw passes through the second decorative plate from the third groove and locks on the first clasp.

16. The card holder according to claim 14, wherein the first clamping plate and the second clamping plate are provided with a guide opening on a side surface far away from the second elastic band, and the guide opening is an opening of a first storage space.

17. The card holder according to claim 6, wherein a number of the clamping plates is two, the clamping plates are a first plate and a second plate respectively; a number of the containing grooves is two and comprises a first embedding groove and a second embedding groove; the first embedding groove and the second embedding groove are arranged on the first plate, a number of the at least a first hanging hole is two, the two first hanging holes are arranged at two ends of the first elastic band, a first through hole and a second through hole are arranged at two ends of the second plate, the first plate is provided with a first avoidance opening connected with the first embedding groove and a second avoidance opening connected with the second embedding groove; two ends of the first elastic band are respectively arranged into the first embedding groove and the second embedding groove, the two first hanging holes are respectively sleeved on the first convex blocks of the first embedding groove and the second embedding groove; one end of the first elastic band extends out of the first embedding 分 groove and then passes through the first avoidance opening and the first through hole in sequence, and extends along a surface of the second plate away from the first plate, and then passes through the second through hole and the second avoidance opening in sequence and is arranged into the second embedding groove, and a second storage space is formed between the first elastic band and the second plate.

18. The card holder according to claim 17, wherein the first plate comprises a base plate and a first decorative plate, and the first embedding groove and the second embedding groove are formed by connecting the base plate and the first decorative plate.

19. The card holder according to claim 18, wherein the first decorative plate is able to be detached and arranged on the base plate, the first decorative plate is provided with second images and texts for decoration on the surface far away from the first decorative plate; the second plate is provided with a second decorative plate on one of the surfaces far away from the first plate, the second decorative plate is provided with images and texts for decoration, and at least part of the second decorative plate is arranged between the first elastic band and the second plate.

20. The card holder according to claim 19, wherein the card holder further comprises a second clasp, the second clasp is arranged on the second plate or the first elastic band; the second clasp is provided with pass-through holes at positions adjacent to both ends, both ends of the second clasp is provided with entrances connected with the pass-through holes, and the first elastic band passes through the two pass-through holes.

* * * * *